US006798435B2

(12) United States Patent
Kimura et al.

(10) Patent No.: US 6,798,435 B2
(45) Date of Patent: Sep. 28, 2004

(54) PRINTER

(75) Inventors: Kenichi Kimura, Miyagi (JP); Genzi Oshino, Miyagi (JP)

(73) Assignee: Tohoku Ricoh Co., Ltd., Miyagi (JP)

( * ) Notice: Subject to any disclaimer, the term of this patent is extended or adjusted under 35 U.S.C. 154(b) by 0 days.

(21) Appl. No.: 09/912,503

(22) Filed: Jul. 26, 2001

(65) Prior Publication Data

US 2002/0012039 A1 Jan. 31, 2002

(30) Foreign Application Priority Data

Jul. 26, 2000 (JP) ..... 2000-224924

(51) Int. Cl.[7] ..... B41J 11/00
(52) U.S. Cl. ..... 347/218
(58) Field of Search ..... 347/218, 220, 347/215, 217, 775; 271/209, 275, 277; 400/578, 617, 636, 636.2; 362/249; 101/288; 134/122 R; 346/145; 226/181; 250/316

(56) References Cited

U.S. PATENT DOCUMENTS 4,505,603 A * 3/1985 Yana ..... 346/145
4,695,173 A * 9/1987 Tomida ..... 134/122 R
4,887,095 A * 12/1989 Wataya et al. ..... 347/218
4,948,282 A * 8/1990 Koike et al. ..... 101/288
5,221,035 A * 6/1993 Suzuki et al. ..... 226/181
5,360,278 A * 11/1994 Fukahori et al. ..... 347/217
5,547,183 A * 8/1996 Tamura ..... 271/209
5,646,361 A * 7/1997 Morrow ..... 362/249
5,813,783 A * 9/1998 Takatori ..... 347/218
5,988,907 A * 11/1999 Iso ..... 400/636
6,183,151 B1 * 2/2001 Kono ..... 400/578
6,278,472 B1 * 8/2001 Sasaki et al. ..... 347/175

FOREIGN PATENT DOCUMENTS

JP 4-49068 2/1992
JP 11-342643 12/1999

* cited by examiner

*Primary Examiner*—K. Feggins
(74) *Attorney, Agent, or Firm*—Westerman, Hattori, Daniels & Adrian, LLP

(57) ABSTRACT

One roller (6) of paired feed rollers is a driving roller which is rotated by a motor (8), and a platen (3) and the other roller (which is a driven roller) (7) of the paired feed rollers are rotatably mounted on a swingable bracket (11) through a platen support member (12) and a roller support member (13) respectively to be free from being rotated by the motor (8).

5 Claims, 6 Drawing Sheets

PRINTER

BACKGROUND OF THE INVENTION

1. Field of the Invention

The invention relates to a printer for feeding a printed sheet (paper), which has been printed between a thermal head and a platen, by paired feed rollers provided downstream the thermal head in the feeding direction and, more specifically, to a printer suitable for using a printable sheet composed of a double film.

2. Description of the Related Art

As a printing portion of a conventional printer for performing printing on a printable sheet by a thermal head and a platen, for example, there is one shown in FIG. 8. The printing portion of this printer performs printing by a thermal head 61 while a platen 62 is rotated by a driving power source in the direction of the arrow denoted at A with a printable sheet 63 and a thermal transfer ribbon 64 sandwiched between the thermal head 61 and the platen 62.

However, in the case of a printer structured such that the platen to which the thermal head is pressed to contact through the printable sheet and the thermal transfer ribbon (only the printable sheet when it is thermal paper), as described above, is rotated by turning effort applied from the driving power source, there often occurs a problem depending on the kind of printable sheet in use.

Such a problem occurs, for example, when a printable sheet 68 is used which is in a form of double film, made by folding a film into two of a film 68*a* and a film 68*b*, folded at one edge side with the other edge side open with respect to the feeding direction of the arrow denoted at D as shown in FIG. 9. In other words, when printing is performed on the printable sheet 68, the film 68*b* contacting the platen 62 is fed by the feeding force of the platen 62, but the film 68*a* on the thermal head 61 side is hard to be fed due to occurrence of slippage with respect to the film 68*b* as shown in FIG. 10.

Thus, in this case, wrinkles occur on the printable sheet 68 as shown in FIG. 10 and it can not be fed in a proper manner.

SUMMARY OF THE INVENTION

The present invention is made in viewpoint of the above-described problem, and its object is to make it possible to perform printing on a printable sheet, even if a printable sheet composed of a double film is used, and to surely feed it.

In order to attain the above object, in a printer for feeding a printed sheet which has been printed between a thermal head and a platen by paired feed rollers provided downstream the thermal head in a feeding direction, the platen is rotatably provided free from being rotated by a driving power source, and one roller of the paired feed rollers located on the thermal head side with respect to the printed sheet is a driving roller which is rotated by the power source, and the other roller located on the platen side is a driven roller which is not rotated by the driving power source.

In the above-described printer, it is preferable to provide a moving member on which the thermal head and the driving roller, or the platen and the driven roller are mounted, the moving member being held on a fixing portion to be movable in a direction in which the thermal head and the platen, and the driving roller and the driven roller, respectively, approach to, or separate from, each other, so that when the moving member is moved in the direction of separation, portions between the thermal head and the platen and between the driving roller and the driven roller are both exposed to an outside of the printer.

Further, it is preferable that a portion of the driving roller contacting the printed sheet is formed of nonadhesive rubber.

Further, it is suitable to provide, similarly to the above-described printer, a moving member on which the thermal head and the driving roller, or the platen and the driven roller are mounted, the moving member being held on a fixing portion to be movable in a direction in which the thermal head and the platen, the driving roller and the driven roller, respectively, approach to, or separate from, each other; paired pressing rollers continuously pressing against each other provided downstream of the driving roller and the driven roller in a feeding direction of the printed sheet; and driving means for independently rotating the pressing roller.

The above and other objects, features and advantages of the invention will be apparent from the following detailed description which is to be read in conjunction with the accompanying drawings.

DETAILED DESCRIPTION OF THE PREFERRED EMBODIMENTS

Figure 1:
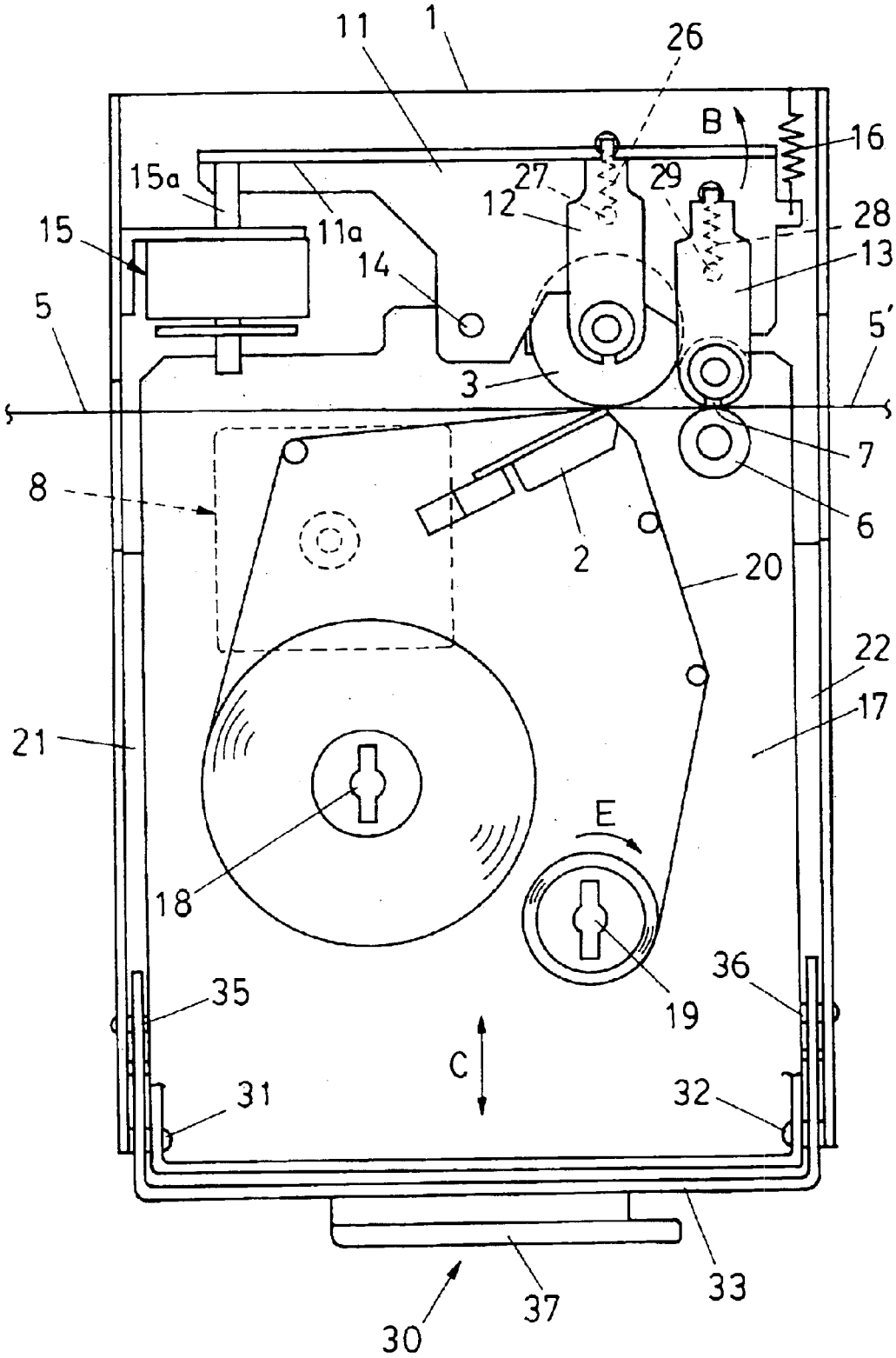
FIG. 1 is a plan view showing a main portion of a first embodiment of a printer according to the invention with a platen side top cover and a thermal head side top cover both removed.

Hereinafter, preferred embodiments of the invention will be explained

A first embodiment of the invention is explained with reference to FIG. 1 to FIG. 6. In a printer shown in FIG. 1, a printed sheet (paper) 5', which has been printed between a thermal head 2 and a platen 3 independently provided in a frame 1 that is a fixing portion of the printer, is fed by paired feed rollers constituted of rollers 6 and 7 provided downstream the thermal head 2 in a feeding direction (on the right-hand side in FIG. 1).

Further, in this printer, the platen 3 is rotatably mounted on a platen support member 12 while free from being rotated by a motor 8 that is a driving power source, and the platen support member 12 is mounted on a swingable bracket 11.

The platen support member 12 is held by the swingable bracket 11 to be movable in a direction to approach to, and separate from, the thermal head 2 by a guide portion (not shown). To a spring locking part formed on one end of the platen support member 12, one end of an extension urging spring 26 is attached.

The other end of the extension urging spring 26 is attached to a spring locking pin 27 which is fixed to the swingable bracket 11.

Accordingly, the platen support member 12 is always urged against the thermal head 2 side by the urging force of the extension urging spring 26. When the platen 3 is separated from the thermal head 2, its position is restricted by a stopper member (not shown).

One roller 6 of the paired feed rollers located on the thermal head 2 side with respect to the printable sheet 5 is the driving roller which is rotated by the motor 8. The other roller 7 located on the platen 3 side is the driven roller which is not rotated by (is in free state from) the motor 8.

The platen 3 is rotatably mounted on the swingable bracket 11 through the platen support member 12 as described above, and the driven roller 7 is also rotatably mounted on the swingable bracket 11 through a roller support member 13.

The roller support member 13 is held by the swingable bracket 11 to be movable in a direction to approach to and separate from the roller 6 by a guide portion not shown, and one end of an extension urging spring 28 is attached to a spring locking part formed on one end of the roller support member 13.

The other end of the extension urging spring 28 is attached to a spring locking pin 29 which is fixed to the swingable bracket 11.

Accordingly, the roller support member 13 is always urged against the roller 6 side by the urging force of the extension urging spring 28. When the roller 7 is separated from the roller 6, its position is restricted by a stopper member (not shown).

The swingable bracket 11 is swingably supported by the frame 1 with a shaft 14 substantially at the middle in the lateral direction in FIG. 1. To the right end portion of the swingable bracket 11, one end of a spring 16 is attached, and the other end portion of the spring 16 is attached to the frame 1. Thus, the swingable bracket 11 is always urged to turn in the direction of the arrow B by urging force of the spring 16.

An upper side edge of the swingable bracket 11 in FIG. 1 is bent at the substantially right angle to form a plunger contacting wall 11*a* there. A plunger 15*a* of a solenoid 15 whose main body is fixed to the frame 1 contacts the plunger contacting wall 11*a*.

Figure 2:
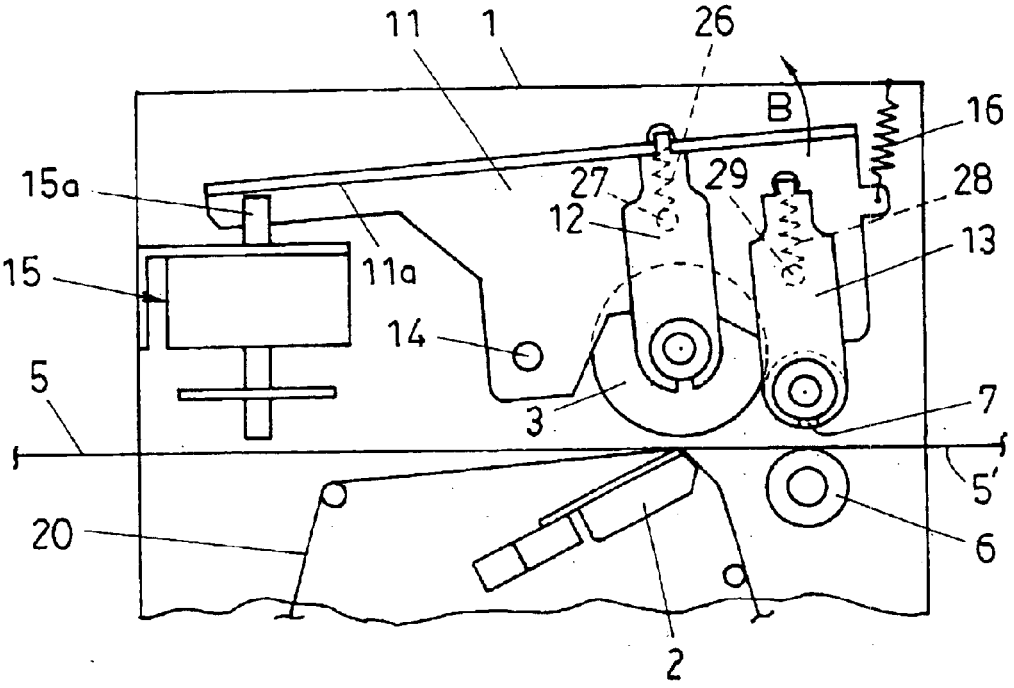
FIG. 2 is a schematic plan view showing a state in which a swingable bracket provided in the printer is swung in a direction in which a platen separates from a thermal head of the same embodiment.

While no current flows through the solenoid 15, the plunger 15*a* is located at the position shown in FIG. 2, and the swingable bracket 11 thus swings in the direction of the arrow B by the urging force of the spring 16 exerting to contract to be located at the position shown in FIG. 2. At the position, the platen 3 is separated from the thermal head 2 and the driven roller 7 of the paired feed rollers is also separated from the driving roller 6.

While current flows through the solenoid 15, the plunger 15*a* is located at the position shown in FIG. 1, and the swingable bracket 11 thus swings in the direction opposite to the direction of the arrow B against the urging force of the spring 16 to be located at the position shown in FIG. 1. Thereby, the platen 3 is pressed to contact the thermal head 2 through the printable sheet 5 and a thermal transfer ribbon 20 by the urging force of the extension urging spring 26. Further, the driven roller 7 is also pressed to contact the driving roller 6 through the printed sheet 5' by the urging force of the extension urging spring 28.

The thermal head 2 is fixed to a moving frame 17 that is a moving member movable in the direction of the arrow C in FIG. 1, and to the moving frame 17, the driving roller 6 of the paired feed rollers is rotatably attached.

On the moving frame 17, a ribbon supply shaft 18 to which the thermal transfer ribbon 20 is mounted and a ribbon winding shaft 19 are also rotatably mounted. To the ribbon winding shaft 19, turning effort of the motor 8 is transmitted via a turning effort transmitting system (not shown) using a gear, a pulley and the like, so that the ribbon winding shaft 19 rotates in the direction of the arrow E.

The moving frame 17 is supported to be slidable in the direction of the arrow C by slide support members 21 and 22 using, for example, bearings or the like, whose faces on either side are fixed to faces on either side of the frame 1 respectively. When the moving frame 17 is moved to the position capable of printing shown in FIG. 1, it is to be locked at the position by a lock mechanism 30.

Figure 3:
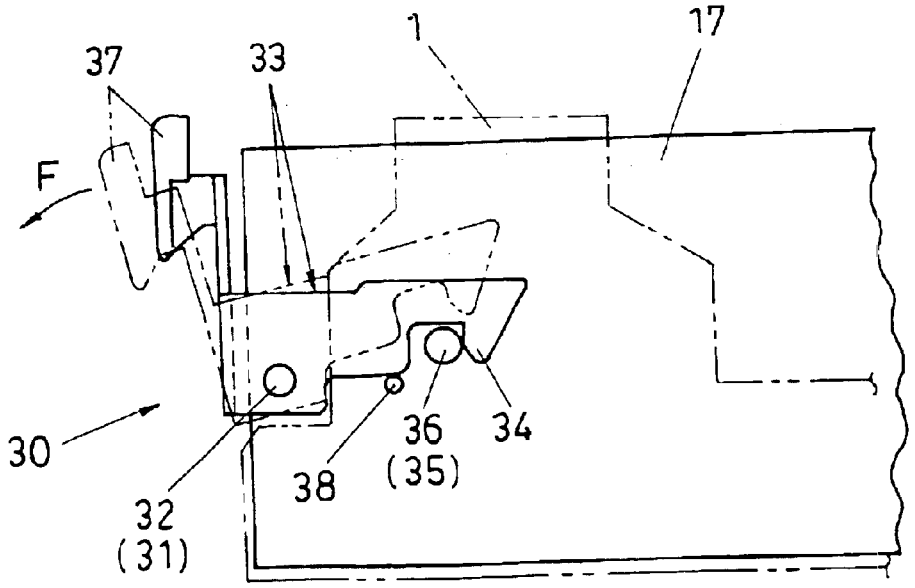
FIG. 3 is a side view for explaining a lock mechanism provided in the printer.

The lock mechanism 30 comprises a lock lever 33 and engaging shafts 35 and 36. The lock lever 33 is, as shown in FIG. 3, turnably supported on both side faces of the moving frame 17 by shafts 31 and 32, and formed with lock latches 34 and 34 at both end portions respectively. The lock lever 33 is formed with a grip 37 for operation.

The engaging shafts 35 and 36 are respectively fixed to both side faces of the frame 1 corresponding to the lock latches 34 of the lock lever 33.

The lock lever 33 is always urged to turn in the clockwise direction in FIG. 3 by a spring not shown. By contacting stopper pins 38 and 38 which are respectively fixed to both side faces of the moving frame 17, the lock lever 33 is restrained at the position shown by a solid line in FIG. 3.

When the moving frame 17 is located at the position shown in FIG. 1, both lock latches 34 and 34 of the lock lever 33 on the both sides respectively engage with the engaging shafts 35 and 36 on the frame 1 side as shown by the solid line in FIG. 3 to be brought into a lock state, whereby the moving frame 17 is fixed to the frame 1.

When the lock is released, the grip 37 of the lock lever 33 is turned in the direction of the arrow F in FIG. 3, thereby releasing the lock latches 34 and 34 on both sides from the engaging shafts 35 and 36. This allows the moving frame 17 to be drawn from the frame 1 leftward in FIG. 3.

Figure 4:
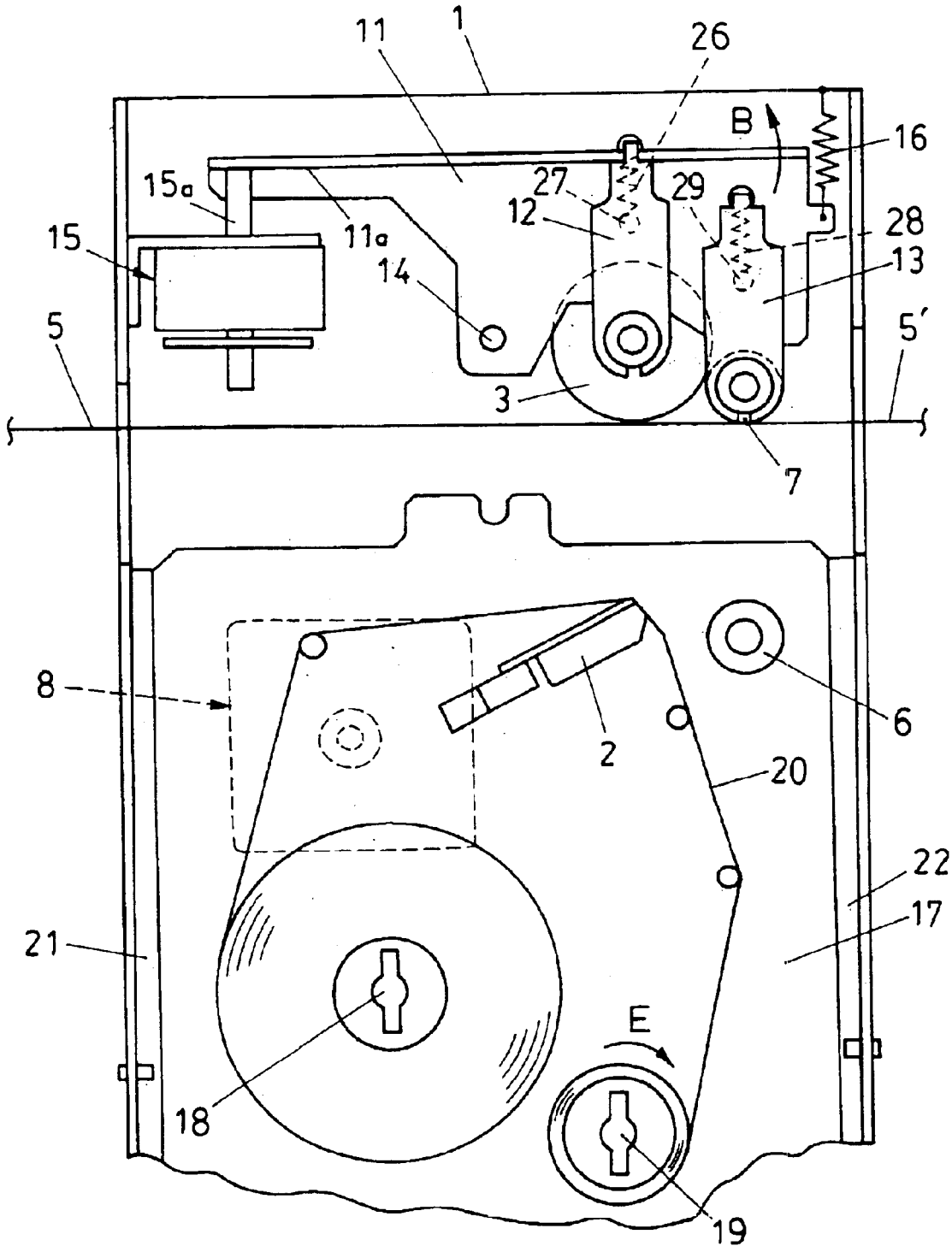
FIG. 4 is a plan view showing a state in which when a moving frame of the printer shown in FIG. 1 is moved in the direction of separation, the thermal head separates from the platen and a driving roller also separates from a driven roller of paired feel rollers, with the platen side top cover and the thermal head side top cover both removed.

This printer is structured such that when the moving frame 17 is moved in the direction of separation (leftward in FIG. 3) and located at the position shown in FIG. 4, the thermal head 2 separates from the platen 3, and the driving roller 6 separates from the driven roller 7 of the paired feed rollers.

Figure 5:
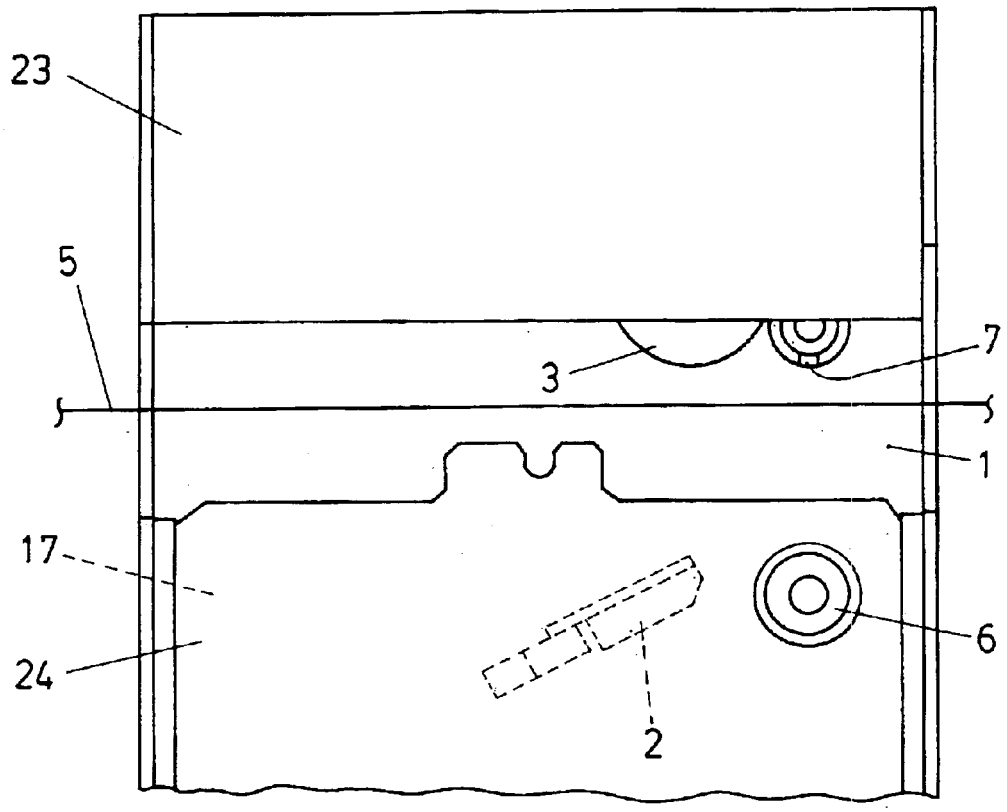
FIG. 5 is a plan view showing the state in which when the moving frame is moved in the direction of separation, portions between the thermal head and the platen and between the driving roller and the driven roller of paired feed rollers are exposed to the outside of the printer.

As for this printer, the upper side of the platen 3 and the driven roller 7 are covered with a platen side top cover 23 as shown in FIG. 5. Similarly, the upper side of the thermal head 2 and the driving roller 6 are covered with a thermal head side top cover 24. The thermal head side top cover 24 is screwed to the moving frame 17 (located under the thermal head side top cover 24), and thus when the thermal head side top cover 24 is moved integrally with the moving frame 17 to the position shown in FIG. 5, portions between the thermal head 2 and the platen 3 and between the driving roller 6 and the driven roller 7 are exposed to the outside of the printer as shown in FIG. 5.

Accordingly, in this printer, when the printable sheet 5 is set, the moving frame 17 is moved in the direction of separation as described above, and the printable sheet 5 is inserted into both exposed portions between the thermal head 2 and the platen 3 and between the driving roller 6 and the driven roller 7 of the paired feed rollers as shown in FIG. 5. Thereafter, only by moving the moving frame 17 in the direction to close and locating it at the position shown in FIG. 1, the printable sheet 5 can be easily set.

Figure 6:
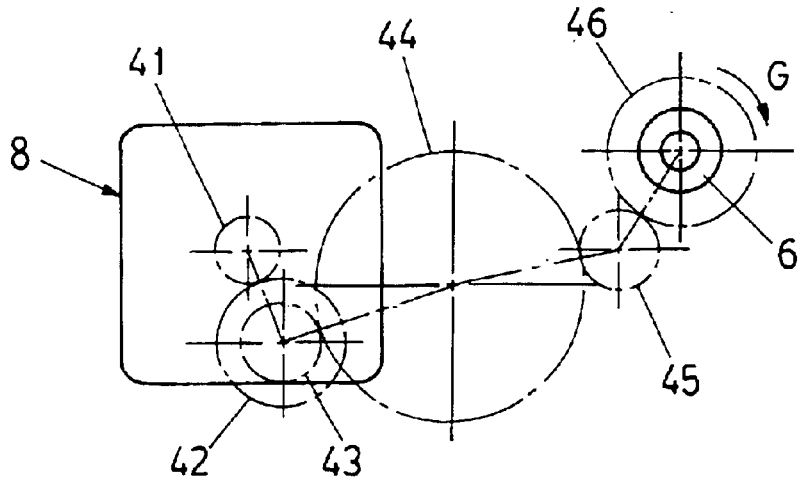
FIG. 6 is a schematic diagram showing a driving system of the driving roller of paired feed rollers for feeding a printed sheet by roughly drawing gears.

FIG. 6 is a schematic view showing the driving system of the driving roller of the paired feed rollers for feeding the printed sheet by roughly drawing gears.

The driving roller 6 is rotated by the turning effort of the motor 8 as described above. The turning effort of the motor 8 is transmitted from a motor gear 41 fixed to a rotary shaft of the motor 8 to a middle gear 42 meshing with the motor gear 41. The turning effort from the middle gear 42 is further transmitted by a small-diameter gear 43 integrated with the middle gear 42 to a large-diameter reduction gear 44 meshing with the small-diameter gear 43.

The turning effort of the reduction gear 44 is transmitted to a middle gear 45 meshing therewith, and the turning effort thereof is transmitted to a roller portion gear 46 meshing with the middle gear 45. Since the roller portion gear 46 is integrated with the driving roller 6, the roller 6 rotates in the direction of the arrow G.

Figure 8:
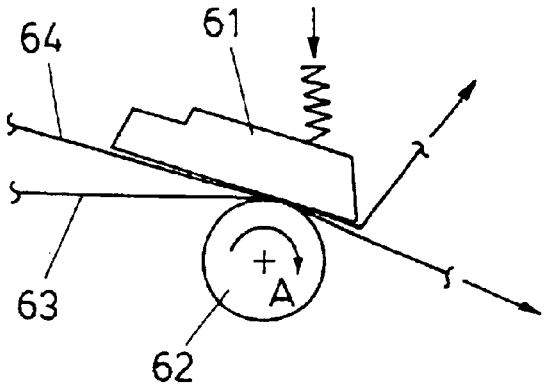
FIG. 8 PRIOR ART
FIG. 8 is a schematic view showing only the platen and the surroundings of an example of a conventional printer in which the platen is rotated by a driving power source.
Figure 9:
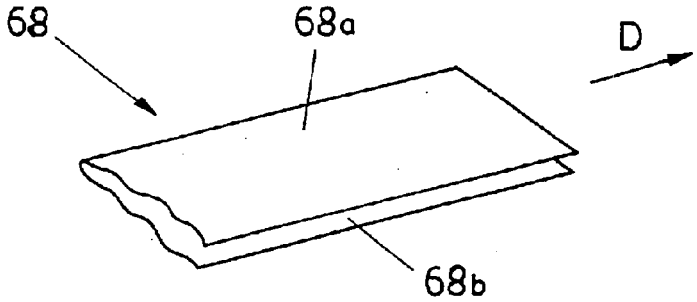
FIG. 9 PRIOR ART
FIG. 9 is a perspective view showing a printable sheet in the form of double film, made by folding a film into two at one edge side.

By the way, in the case of the structure that the platen 62 is supplied with the turning effort of the power source to rotate as in the conventional printer which has been described with FIG. 8, there occurs a problem when the printable sheet 68 is used, which is composed of a double film, made by folding a film into two, folded at one edge side with the other edge side open with respect to the feeding direction as explained with FIG. 9.

Figure 10:
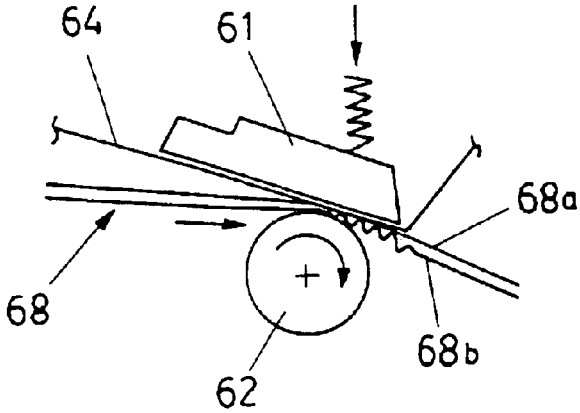
FIG. 10 PRIOR ART
FIG. 10 is a schematic view for explaining the state in which the printer shown in FIG. 8 can not feed a printed sheet in the form of double film in a proper manner.

In other words, it often happens that the film 68*b* contacting the platen 62 is fed by the feeding force of the platen 62, but the film 68*a* on the thermal head 61 side is hard to be fed due to occurrence of slippage with respect to the film 68*b* as explained with FIG. 10, and thus the printable sheet 68 can not be fed in a proper manner.

In the printer described with FIG. 1, and so on, according to the invention, however, the roller located on the thermal head side out of the paired feed rollers is the driving roller 6, and the platen 3 is made free from being rotated by the motor 8, never presenting the above-described problem even if the double film is used.

More specifically, according to the printer in FIG. 1, even if the printable sheet 68 made by doubling a film as explained with FIG. 9 is used for the printable sheet 5, the film of a side contacting the thermal head 2 of the printable sheet 68 is forcibly fed by the driving roller 6, and the film on the platen 3 side is smoothly fed by the platen 3 and the roller 7 which are rotated by the printable sheet 68. Consequently, it is possible to perform printing on the double film and to surely feed it without generation of wrinkling thereon.

It should be noted that this printer is structured, as is clear from FIG. 1, such that the driving roller 6 contacts the printed surface side of the printed sheet 5' printed by the thermal head 2 immediately after the printing. Therefore, the surface of the roller 6 is susceptible to contamination by the printed part, and a portion of the roller 6 contacting the printed sheet 5', that is, the surface of the roller 6 is thus preferably formed of nonadhesive rubber. This makes it possible to prevent the surface of the roller 6 from being contaminated by the printed part.

Figure 7:
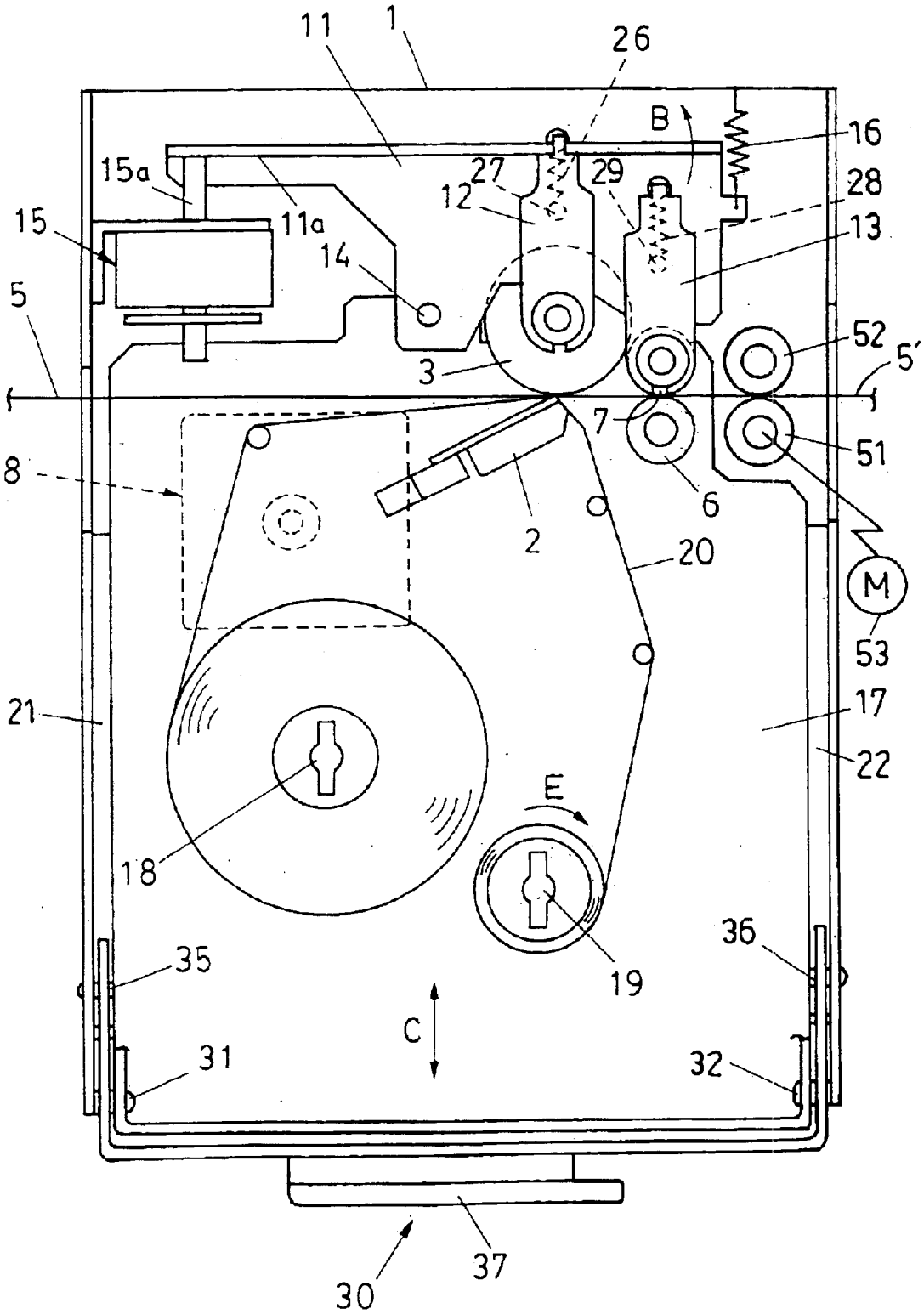
FIG. 7 is a plan view similar to FIG. 1, showing a second embodiment of the printer according to this invention.

FIG. 7 is a plan view similar to FIG. 1, showing a second embodiment of the printer according to the present invention, in which components corresponding to those in FIG. 1 are denoted at the same numerals.

A printer according to this embodiment is different from the printer in FIG. 1 in that paired pressing rollers constituted of rollers 51 and 52 which are continuously pressing against each other are provided downstream the paired feed rollers constituted of the driving roller 6 and the driven roller 7, in the feeding direction of the printed sheet, and a motor 53 is provided, which is a driving means for independently rotating the roller 51 (the roller 52 is possible) of the pressing rollers.

In this printer, the solenoid 15 is turned on during printing to swing the swingable bracket 11 in the direction opposite to the direction of the arrow B, thereby pressing the platen 3 against the thermal head 2 through the printable sheet 5 and the thermal transfer ribbon 20. Further, the driven roller 7 of the paired feed rollers is brought to be pressed against the driving roller 6 through the printed sheet 5', thereby allowing the printed sheet 5' to be sandwiched between the rollers 51 and 52 as shown in FIG. 7.

Then, the driving roller 6 and the roller 51 are both rotated in the same direction at the same speed, at a feeding speed matching with the printing speed by the thermal head 2, and printing is performed in the state.

After the completion of predetermined printing onto the printable sheet 5 by the thermal head 2 and the platen 3, the solenoid 15 is turned off to swing the swingable bracket 11 in the direction of the arrow B by the urging force of the spring 16, thereby separating the platen 3 from the thermal head 2. Further, the driven roller 7 is also separated from the driving roller 6 of the feed rollers.

In this event, the continuous pressing rollers 51 and 52 continue feeding with the printed sheet 5' sandwiched therebetween in the pressing state, whereby the printable sheet 5 continues to be fed without stop.

On the other hand, the thermal transfer ribbon 20 is stopped from being fed.

After the next printing position on the printable sheet 5 is fed, the solenoid 15 is turned on again at a predetermined timing to swing the swingable bracket 11 in the direction opposite to the direction of the arrow B again, thereby pressing the platen 3 against the thermal head 2 through the printable sheet 5 and the thermal transfer ribbon 20. Further, the driven roller 7 is also pressed against the driving roller 6 through the printed sheet 5', and then the next printing is started.

Thereafter, this operation is repeated until a command to print is not given any more.

As described above, in this printer, the platen 3 is separated from the thermal head 2, and the driven roller 7 is separated from the driving roller 6 every completion of printing, thereby releasing the printed sheet 5' and the thermal transfer ribbon 20 from the sandwiching by them.

Even with the above operation, this printer continues sandwiching the printed sheet 5' by the paired continuous pressing rollers 51 and 52 which are provided downstream the rollers 6 and 7, and thus it is possible to continue to hold the printed sheet 5' by the rollers 51 and 52.

The thermal head 2 and the platen 3 are separated, and the driving roller 6 and the driven roller 7 of the paired feed rollers are also separated except during printing, giving no load on the feeding of the printed sheet 5', thereby making it hard to generate meandering feeding that the printed sheet 5' is fed inclined with respect to the feeding direction.

Further, the platen 3 is separated except when necessary, thus reducing wear of the pressing portion thereof against the thermal head 2.

In the case in which the thermal transfer ribbon 20 is fed together with the printable sheet 5 for printing as in this printer, the thermal head 2 and the platen 3, and the driving roller 6 and the driven roller 7 of the paired feed rollers are respectively separated after the printing, whereby even if the printed sheet 5' is fed by the feeding force of the rollers 51 and 52, the thermal transfer ribbon 20 is kept at the position and not fed together with the printed sheet 5'. Accordingly, the thermal transfer ribbon 20 can be kept at the position at the time when the thermal head 2 and the platen 3 are separated (ribbon saving).

In the above description, as the embodiments of the printer according to the invention, the cases are shown respectively, each of which is simplified in structure by providing the swingable bracket 11 that is a moving member on the side of the platen 3 and the driven roller 7 which do not require a driving system. In the present invention, in addition to the above cases, the swingable bracket 11 can be provided on the thermal head 2 side, and the thermal head 2 and the driving roller 6 are provided thereon, thereby also making it possible to similarly contact and separate the thermal head 2 and the platen 3, and the driving roller 6 and the driven roller 7 of the paired feed rollers.

In the embodiment of FIG. 7, the structural example in which the rollers 51 and 52 are provided in the printer is explained. It is also suitable to employ a system that the rollers 51 and 52 are provided outside the printer and operated in synchronization with the feeding system in the printer.

Finally, effects of the invention are described.

In the printer according to the invention, the roller located on the thermal head side of the paired feed rollers is the driving roller and the platen is made free from being rotated by the driving power source, and thus even if the double film made by doubling a film is used as the printable sheet, the printed sheet can be surely fed without wrinkling.

Further, the moving member is provided so that when the moving member is moved in the direction of separation, the portions between the thermal head and the platen and between the driving roller and the driven roller of the paired feed rollers are both exposed to the outside of the printer. In this structure, when the moving member is moved, the portions between the thermal head and the platen and between the driving roller and the driven roller are both exposed to the outside of the printer, so that the printable sheet can be easily set between the thermal head and the platen and between the driving roller and the driven roller.

In the case where the portion of the driving roller contacting the printed sheet is formed of nonadhesive rubber, whereby though the driving roller contacts the printed surface of the printed sheet, the portion becomes hard to be contaminated by printed surface of the printed sheet because the portion of the driving roller contacting the printed sheet is formed of the nonadhesive rubber.

Further, in the case where the paired continuous pressing rollers are provided downstream the driving roller and the driven roller of the paired feed rollers in the feeding direction of the printed sheet, and the rotation means for independently rotating the pressing roller, whereby printing can be performed while the thermal head and the platen are pressed against each other through the printable sheet, and the driving roller and the driven roller can be also pressed against each other through the printed sheet during printing, and the driving roller and the pressing roller can be driven at the same feeding speed during the printing.

After the printing, even if the moving member is moved in the direction of separation to thereby separate the thermal head and the platen, and separate the driving roller and the driven roller of the paired feed rollers to release the printed sheet from the sandwiching by them, the printed sheet can be still kept sandwiched between the paired continuous pressing rollers.

Further, in the case where the thermal head and the platen, and the driving roller and the driven roller of the paired feed rollers are made to be separated respectively except during printing, whereby the feeding system gives no load on the feeding of the printed sheet, thereby preventing occurrence of meandering feeding in which the printed sheet is fed inclined with respect to the feeding direction.

Further, the platen is separated except when necessary, thereby reducing wear of the pressed portion thereof.

In the case where the thermal transfer ribbon is fed together with the printed sheet and wound without passing through the pressing rollers, whereby even when the thermal head and the platen are separated and the driving roller and the driven roller of the paired rollers are separated after the printing and the printed sheet is kept fed by the pressing rollers, the thermal transfer ribbon remains kept at the position at the time when the thermal head is separated from the platen, and is not fed together with the printed sheet, and thus the thermal transfer ribbon can be kept at the position until the next printing is started.

What is claimed is:

1. A printer for unidirectionally feeding a printed sheet which has been printed between a thermal head and a platen, by paired feed rollers provided downstream of said thermal head in a feeding direction, wherein said platen is rotatably provided free from being rotated by a driving power source, and one roller of said paired feed rollers located on said thermal head side with respect to said printed sheet is a driving roller which is rotated by said driving power source, and the other roller located on said platen side is a driven roller which is not rotated by said driving power source.

2. A printer according to claim 1, wherein a portion of said driving roller contacting said printed sheet is formed of nonadhesive rubber.

3. A printer for feeding a printed sheet which has been printed between a thermal head and a platen, by paired feed rollers provided downstream of said thermal head in a feeding direction, wherein said platen is rotatably provided free from being rotated by a driving power source, and one roller of said paired feed rollers located on said thermal head side with respect to said printed sheet is a driving roller which is rotated by said driving power source, and the other roller located on said platen side is a driven roller which is not rotated by said driving power source, and said printer further comprising a moving member on which said thermal head and said driving roller, or said platen and said driven roller are mounted, said moving member being held on a fixing portion to be movable in a direction in which said thermal head and said platen, said driving roller and said driven roller, respectively, approach to or separate from each other, so that when said moving member is moved in a direction of separation, portions between said thermal head and said platen and between said driving roller and said driven roller are both exposed to the outside.

4. A printer according to claim 3, wherein a portion of said driving roller contacting said printed sheet, is formed of nonadhesive rubber.

5. A printer for feeding a printed sheet which has been printed between a thermal head and a platen, by paired feed rollers provided downstream of said thermal head in a feeding direction.

wherein said platen is rotatable provided free from being rotated by a driving power source, and one roller of said paired feed rollers located on said thermal head side with respect to said printed sheet is a driving roller which is rotated by said driving power source, and the other roller located on said platen side is a driven roller which is not rotated by said driving power source, and said printer further comprising:

a moving member on which said thermal head and said driving roller, or said platen and said driven roller are mounted, said moving member being held on a fixing portion to be movable in a direction in which said thermal head and said platen, said driving roller and said driven roller, respectively, approach to or separate from each other;

paired pressing rollers continuously pressing against each other provided downstream of said driving roller and said driven roller in a feeding direction of said printed sheet; and driving mean for independently rotating said pressing roller.

* * * * *

UNITED STATES PATENT AND TRADEMARK OFFICE

CERTIFICATE OF CORRECTION

PATENT NO. : 6,798,435 B2
DATED : September 28, 2004
INVENTOR(S) : Kenichi Kimura et al.

It is certified that error appears in the above-identified patent and that said Letters Patent is hereby corrected as shown below:

Column 9,
Line 13, please delete "," before -- sheet --.
Line 18, please change "." to -- , -- after "direction".
Line 19, change "rotatable" to -- rotatably --.

Signed and Sealed this

Sixteenth Day of August, 2005

JON W. DUDAS
*Director of the United States Patent and Trademark Office*